US007963133B2

(12) United States Patent
Tamezane

(10) Patent No.: US 7,963,133 B2
(45) Date of Patent: Jun. 21, 2011

(54) CYLINDER LOCK AND UNLOCKING DEVICE COMPRISING THEREOF

(75) Inventor: Takumi Tamezane, Aichi (JP)

(73) Assignee: Kabushiki Kaisha Tokai Rika Denki Seisakusho, Aichi (JP)

( * ) Notice: Subject to any disclaimer, the term of this patent is extended or adjusted under 35 U.S.C. 154(b) by 405 days.

(21) Appl. No.: 12/252,492

(22) Filed: Oct. 16, 2008

(65) Prior Publication Data

US 2009/0107194 A1 Apr. 30, 2009

(30) Foreign Application Priority Data

Oct. 25, 2007 (JP) ..... 2007-278115

(51) Int. Cl.
*B60R 25/02* (2006.01)

(52) U.S. Cl. ..... 70/210; 70/379 R; 70/492; 70/419; 70/421

(58) Field of Classification Search ..... 70/379 R, 70/350, 352, 387, 419, 421, 210, 492; 292/DIG. 23
See application file for complete search history.

(56) References Cited

U.S. PATENT DOCUMENTS 4,903,512 A * 2/1990 Leroy et al. ..... 70/379 R
5,263,348 A * 11/1993 Wittwer ..... 70/379 R
5,265,453 A * 11/1993 Konii et al. ..... 70/379 R
5,285,667 A * 2/1994 Fukasawa et al. ..... 70/379 R
5,295,377 A * 3/1994 Moricz et al. ..... 70/379 R
5,577,409 A * 11/1996 Oyabu et al. ..... 70/379 R
5,640,864 A * 6/1997 Miyamoto ..... 70/379 R
5,704,234 A * 1/1998 Resch ..... 70/371
5,732,580 A * 3/1998 Garnault et al. ..... 70/422
5,775,147 A * 7/1998 Wittwer ..... 70/379 R
5,907,963 A * 6/1999 Myers et al. ..... 70/371
5,911,766 A * 6/1999 Lieb et al. ..... 70/422
5,970,762 A * 10/1999 Myers et al. ..... 70/492
6,058,751 A * 5/2000 Dimig et al. ..... 70/419
6,523,382 B1 * 2/2003 Dimig et al. ..... 70/496
6,711,924 B2 * 3/2004 Ritz ..... 70/422
6,938,446 B2 9/2005 Fukunaga et al.
6,978,645 B2 * 12/2005 Shimon ..... 70/379 R (Continued)

FOREIGN PATENT DOCUMENTS

JP 2002-129805 A 5/2002

*Primary Examiner* — Suzanne D Barrett
(74) *Attorney, Agent, or Firm* — Roberts Mlotkowski Safran & Cole P.C.

(57) ABSTRACT

A cylinder lock, includes a sleeve, a key plug arranged in the sleeve and having a key insert hole opening on an edge face of a key insert side, a key matching member movably supported on the key plug, detachably arranged in the sleeve and withdrawn from the sleeve by an insertion of a matching key into the key insert hole, and a clutch arranged on an opposite side of the key insert side of the sleeve for transmitting an unlocking movement of an operating handle to a locking mechanism. The clutch has an input clutch element pivoting/moving by an input of the unlocking movement of the operating handle and an output clutch element moving by receiving a moving force from the input clutch element, the output clutch element is detachably coupled with the sleeve, and the input clutch element is detachably coupled with the sleeve and is arranged in a position to withdraw the output clutch element from the sleeve moving in an axial direction by a pivotal movement by the input of the unlocking movement in a locking state of the key matching member.

10 Claims, 9 Drawing Sheets

U.S. PATENT DOCUMENTS

| | | | | |
|---|---|---|---|---|
| 7,472,570 | B2 * | 1/2009 | Yamaguchi et al. | 70/379 R |
| 7,716,960 | B2 * | 5/2010 | Tamezane et al. | 70/361 |
| 2004/0250579 | A1 * | 12/2004 | Capka et al. | 70/492 |
| 2007/0209412 | A1 * | 9/2007 | Shiramizu et al. | 70/276 |
| 2009/0031768 | A1 * | 2/2009 | Yamaguchi et al. | 70/357 |
| 2009/0031770 | A1 * | 2/2009 | Yamaguchi et al. | 70/367 |
| 2009/0031772 | A1 * | 2/2009 | Yamaguchi et al. | 70/453 |

* cited by examiner

CYLINDER LOCK AND UNLOCKING DEVICE COMPRISING THEREOF

The present application is based on Japanese Patent Application No. 2007-278115 filed on Oct. 25, 2007, the entire contents of which are incorporated herein by reference.

BACKGROUND OF THE INVENTION

1. Field of the Invention

The present invention relates to a cylinder lock and un unlocking device comprising thereof, in more particular, to a cylinder lock and un unlocking device comprising thereof to unlock a door locking mechanism in a vehicle door panel.

2. Related Art

For example, there is a conventional locking and unlocking device comprising a clutch (a link mechanism for actuator) intermitting by a pivotal operation of a regular key (a matching key) (JP-A 2002-129805).

This locking and unlocking device comprises a link mechanism for handle which produces a pivotal movement by a handle extraction operation, a rod for handle which produces a descending linear motion by the pivotal movement of the link mechanism for handle, and a coupling lever mechanism which transmits the linear motion of the rod for handle to the above-mentioned link mechanism for actuator.

Furthermore, this locking and unlocking device comprises a cylinder lock housed in a handle with a rotor pivoting by an insertion pivotal operation of the matching key, a rod for cylinder lock pivoting by a pivotal movement of the rotor of the cylinder lock, and a key lever mechanism transmitting the pivotal movement of the rod for the cylinder lock to the above-mentioned link mechanism for actuator.

In such a locking and unlocking device, when the rotor pivots in one direction from a neutral position by an insertion pivotal operation of the matching key into the cylinder lock, this pivot movement is transmitted to the key lever mechanism via the rod for cylinder lock, the intermittence of the link mechanism for actuator in a door lock actuator is switched by the operation of the key lever mechanism and the state of the door locking mechanism is changed from locking to unlocking.

When the handle is subsequently operated in a direction to open the door panel, this handle extraction operation is transmitted to the rod for handle via the link mechanism for handle. When the rod for handle moves downwards linearly by the handle extraction operation, the linear motion is transmitted to the link mechanism for actuator via the coupling lever mechanism. When the link mechanism for actuator is activated, since the door locking mechanism is in an unlocking state, the door panel is opened.

Meanwhile, when the rotor pivots in another direction from the neutral position by an insertion pivotal operation of the matching key into the cylinder lock, this pivot movement is transmitted to the key lever mechanism via the rod for cylinder lock, the link mechanism for actuator is activated by the operation of the key lever mechanism and the state of the door locking mechanism is changed from unlocking to locking.

However, in the locking and unlocking device disclosed by JP-A 2002-129805, since a rod for cylinder lock and a key lever mechanism are also provided other than a clutch, a cylinder lock and a handle, there are problems in that the number of parts assembled increases, the entire structure becomes complicated and the cost also increases.

Furthermore, in the locking and unlocking device disclosed by JP-A 2002-129805, since it has a structure in which the rod for cylinder and the key lever mechanism are intermediated between the cylinder lock and the clutch, there are problems in that the outside dimension becomes large and the entire structure grows in size.

THE SUMMARY OF THE INVENTION

Therefore, it is an object of the invention to provide a cylinder lock an unlocking device comprising thereof by which it is possible to reduce the number of parts assembled resulting in lower costs and miniaturization or simplification of the entire structure.

[1] According to the present invention, a cylinder lock comprises:

a sleeve;

a key plug arranged in the sleeve and having a key insert hole opening on an edge face of a key insert side;

a key matching member movably supported on the key plug, detachably arranged in the sleeve and withdrawn from the sleeve by an insertion of a matching key into the key insert hole; and a clutch arranged on an opposite side of the key insert side of the sleeve for transmitting an unlocking movement of an operating handle to a locking mechanism, wherein the clutch has an input clutch element pivoting/moving by an input of the unlocking movement of the operating handle and an output clutch element moving by receiving a moving force from the input clutch element;

the output clutch element is detachably coupled with the sleeve; and the input clutch element is detachably coupled with the sleeve and is arranged in a position to withdraw the output clutch element from the sleeve moving in an axial direction by a pivotal movement by the input of the unlocking movement in a locking state of the key matching member.

[2] According to the present invention, an unlocking device comprises:

a cylinder lock operated by an insertion of a matching key; and an operating handle producing an unlocking movement for unlocking a locking mechanism, wherein the cylinder lock comprises:

a sleeve;

a key plug arranged in the sleeve and having a key insert hole opening on an edge face of a key insert side;

a key matching member movably supported on the key plug, detachably arranged in the sleeve and withdrawn from the sleeve by an insertion of a matching key into the key insert hole; and a clutch arranged on an opposite side of the key insert side of the sleeve for transmitting an unlocking movement of the operating handle to a locking mechanism, wherein the clutch has an input clutch element pivoting/moving by an input of the unlocking movement and an output clutch element moving by receiving a moving force from the input clutch element;

the output clutch element is detachably coupled with the sleeve; and the input clutch element is detachably coupled with the sleeve and is arranged in a position to withdraw the output clutch element from the sleeve moving in an axial direction by a pivotal movement by the input of the unlocking movement in a locking state of the key matching member.

EFFECT OF THE INVENTION

According to present invention, it is possible to reduce the number of parts assembled and to seek lower costs and miniaturization or simplification of the entire structure.

BRIEF DESCRIPTION OF THE DRAWINGS

Next, the present invention will be explained in more detail in conjunction with appended drawings, wherein:

FIGS. 2A and 2B are views shown for explaining a cylinder lock of the unlocking device in the preferred embodiment according to the present invention, wherein FIG. 2A is a side view and FIG. 2B is a rear view;

FIGS. 3A and 3B are views showing a standby state of the cylinder lock in the preferred embodiment according to the present invention, wherein FIG. 3A is a front view and FIG. 3B is a cross sectional view along line A-A in FIG. 3A;

FIGS. 8A and 8B are views showing an operating condition of the cylinder lock in the preferred embodiment according to the present invention by a matching key, wherein FIG. 8A is a front view and FIG. 8B is a cross sectional view along line E-E in FIG. 8A; and FIGS. 9A and 9B are views showing an operating condition of the cylinder lock in the preferred embodiment according to the present invention by the unauthorized key, wherein FIG. 9A is a front view and FIG. 9B is a cross sectional view along line F-F in FIG. 9A.

DESCRIPTION OF THE PREFERRED EMBODIMENT

Preferred Embodiment

Figure 1:
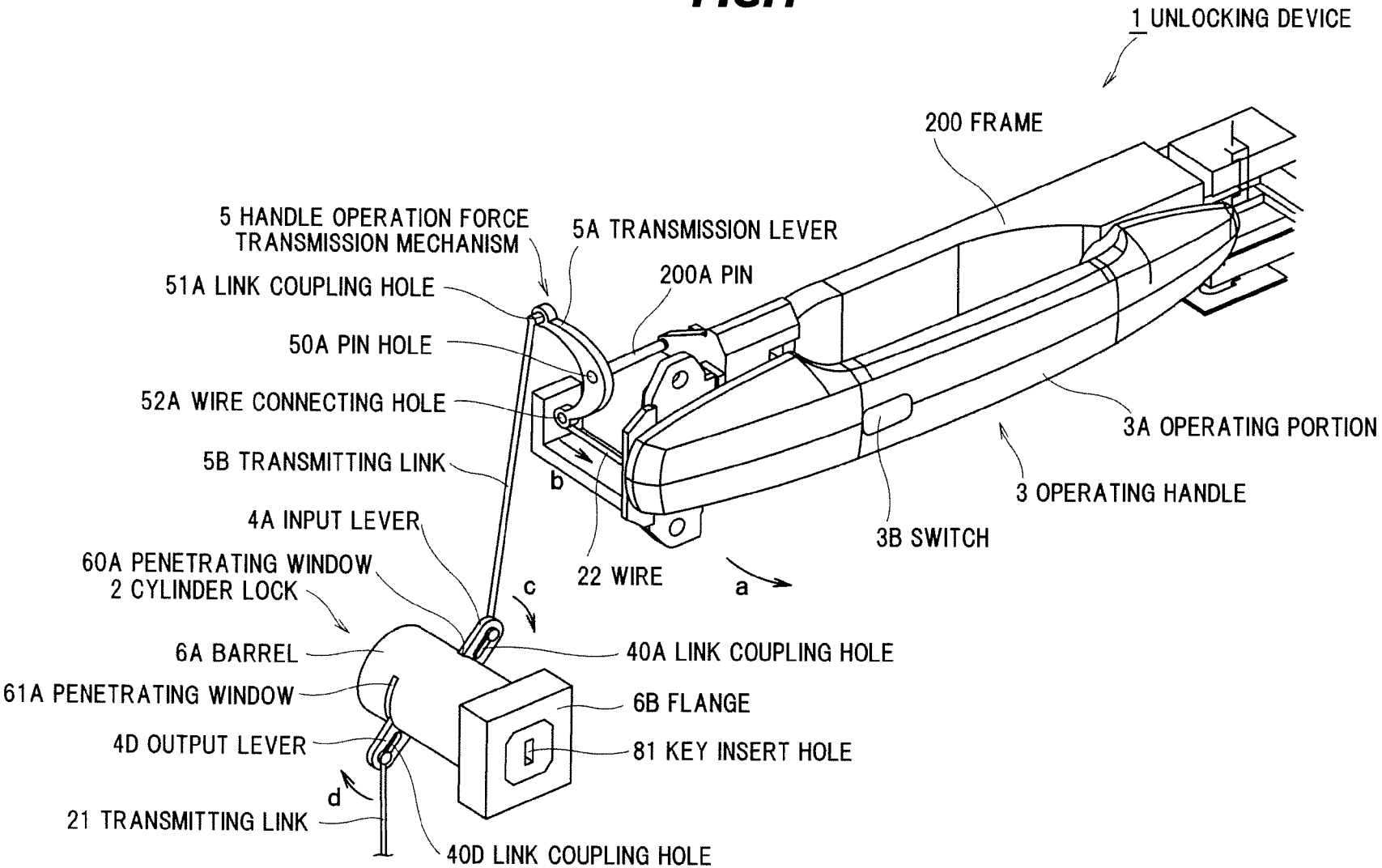
FIG. 1 is a perspective view shown for explaining the entire unlocking device in a preferred embodiment according to the present invention.
Figure 2B:
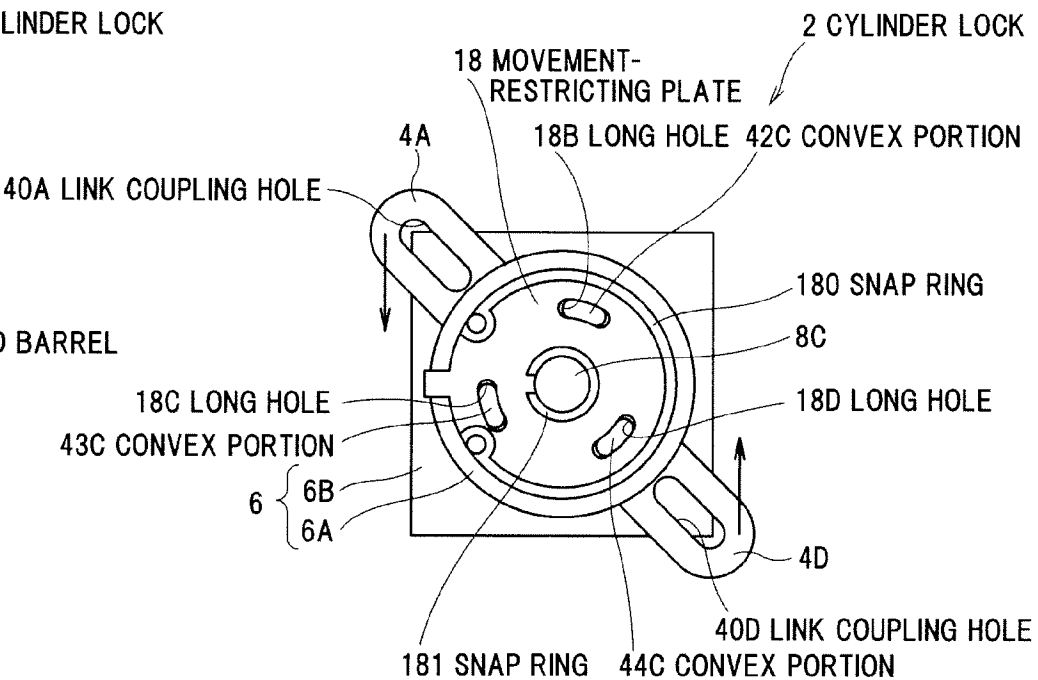
Figure 2A:
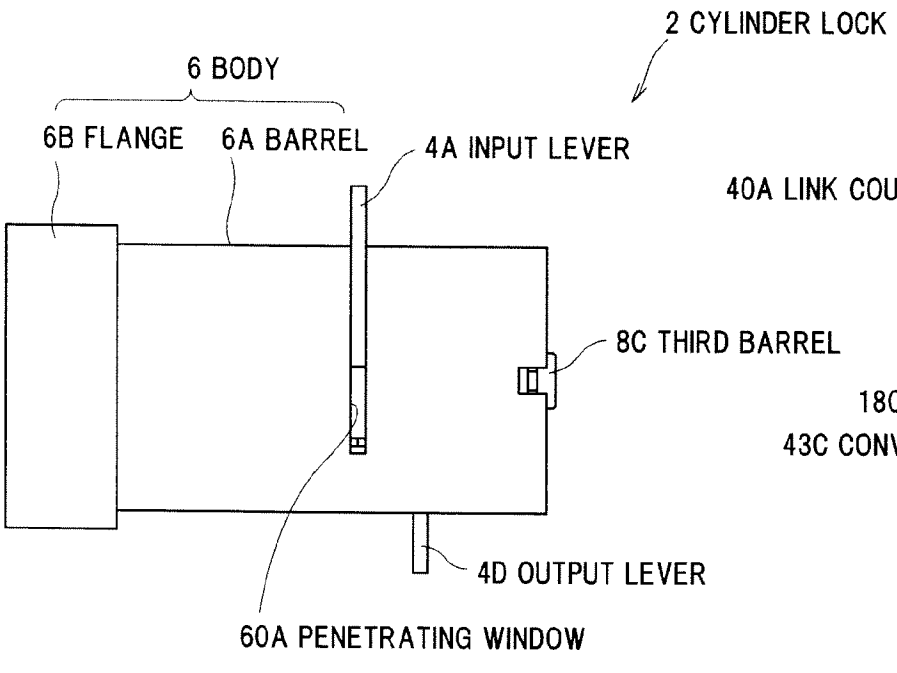
Figure 3B:
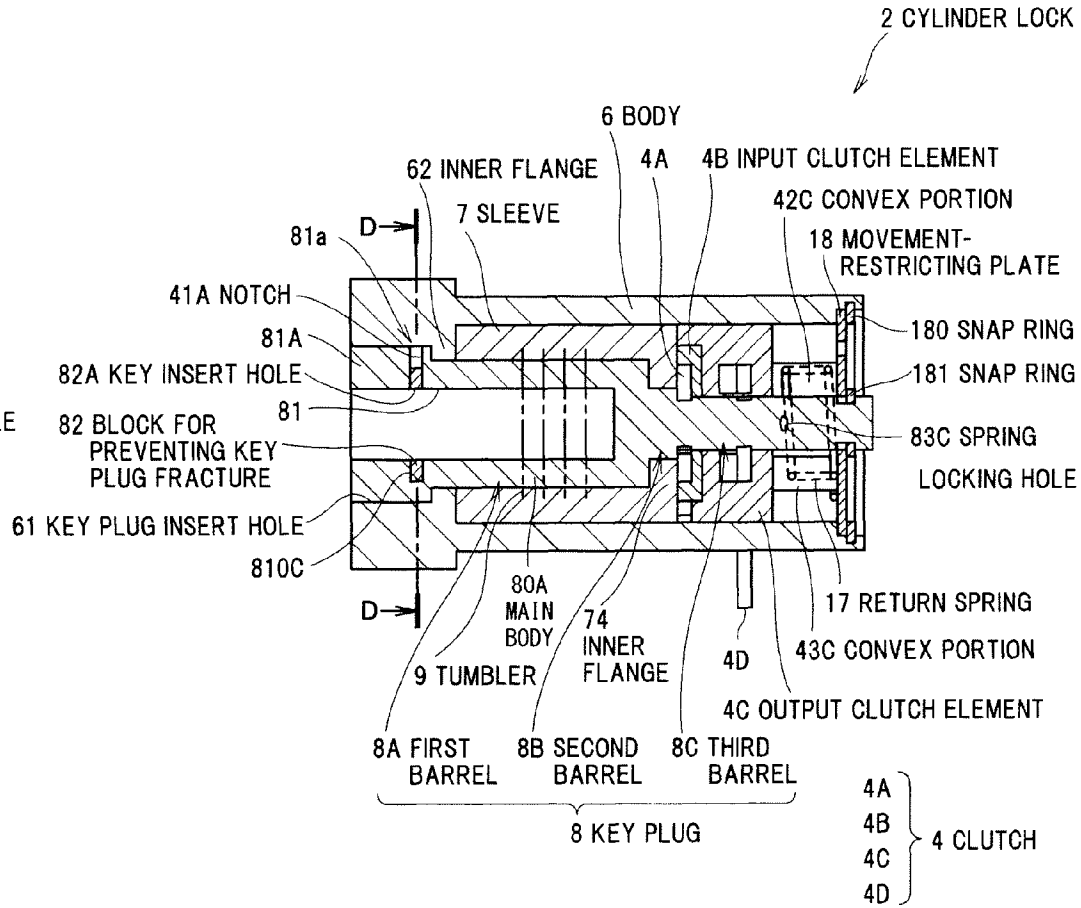
Figure 3A:
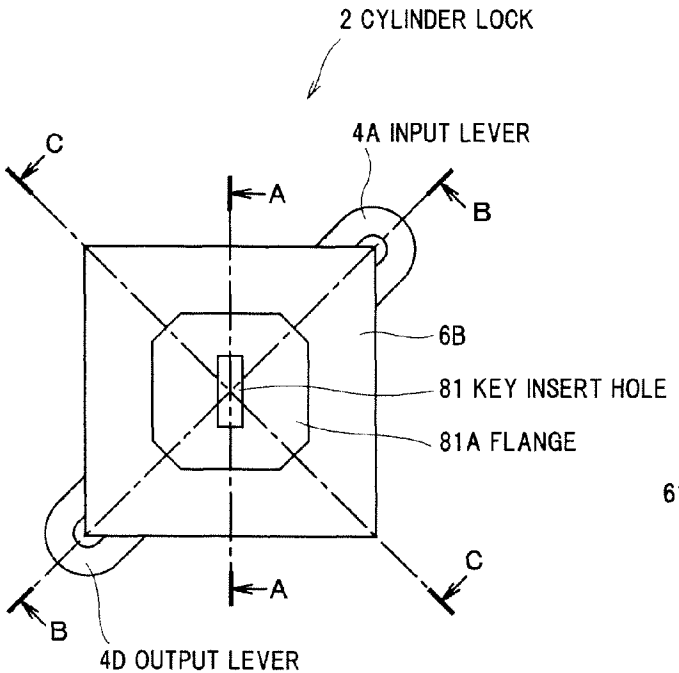
Figure 4B:
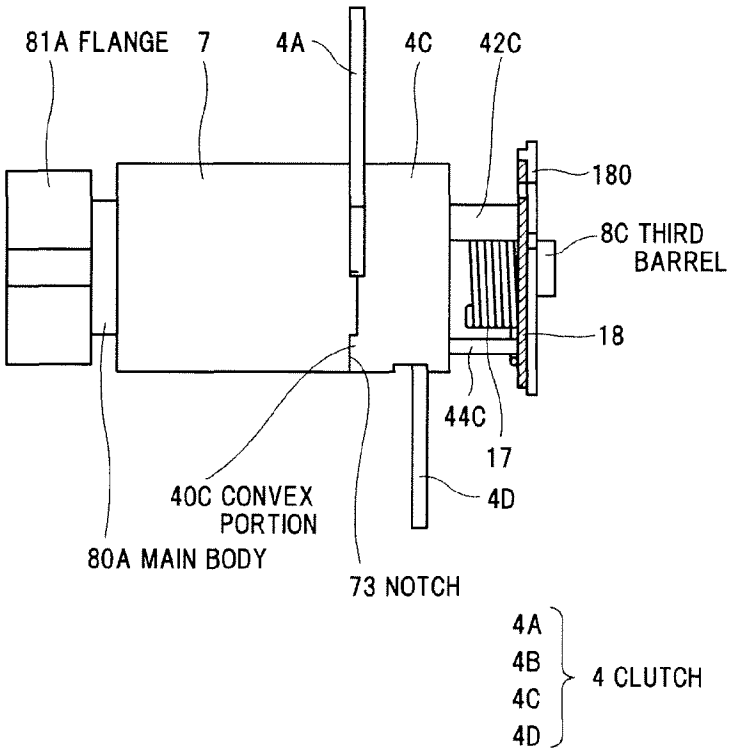
FIGS. 4A and 4B are a cross sectional view along line B-B in FIG. 3A and a side view.
Figure 4A:
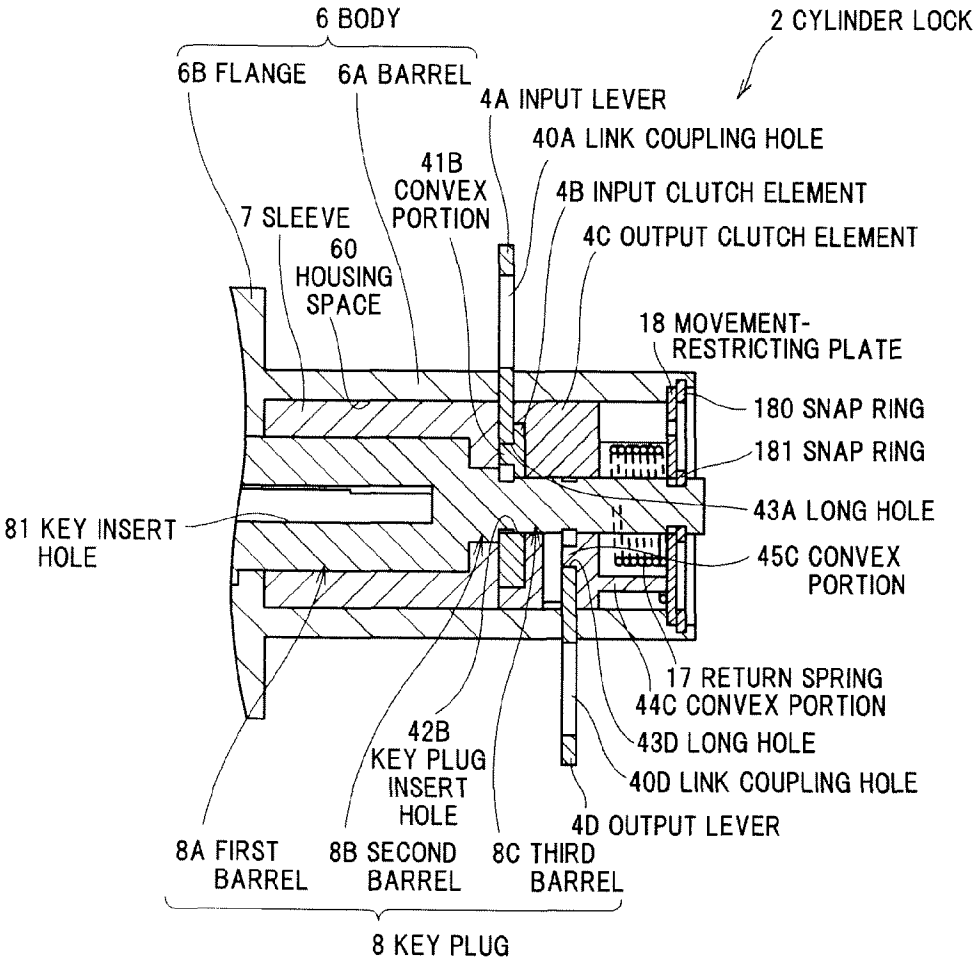
Figure 5:
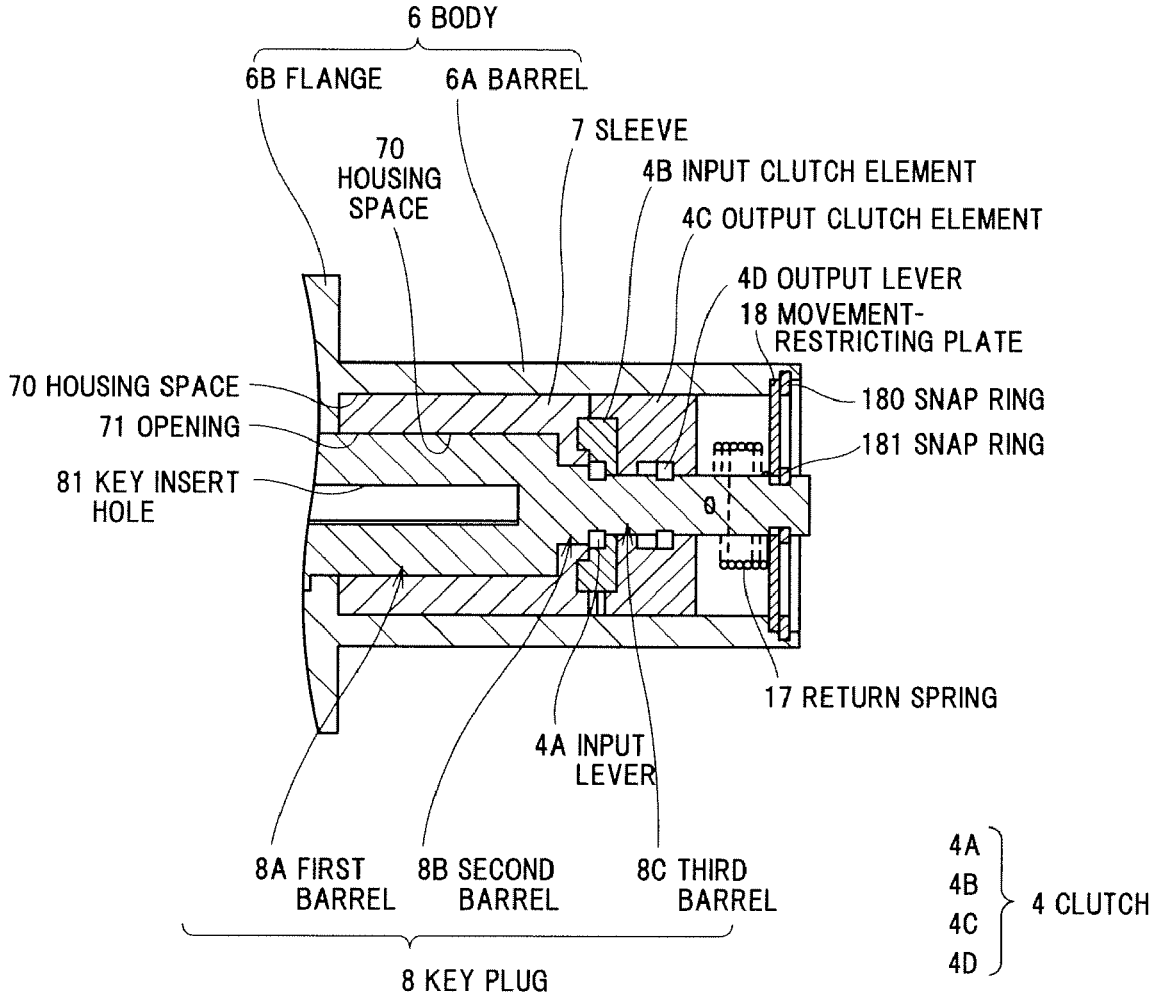
FIG. 5 is a cross sectional view along line C-C in FIG. 3A.
Figure 6:
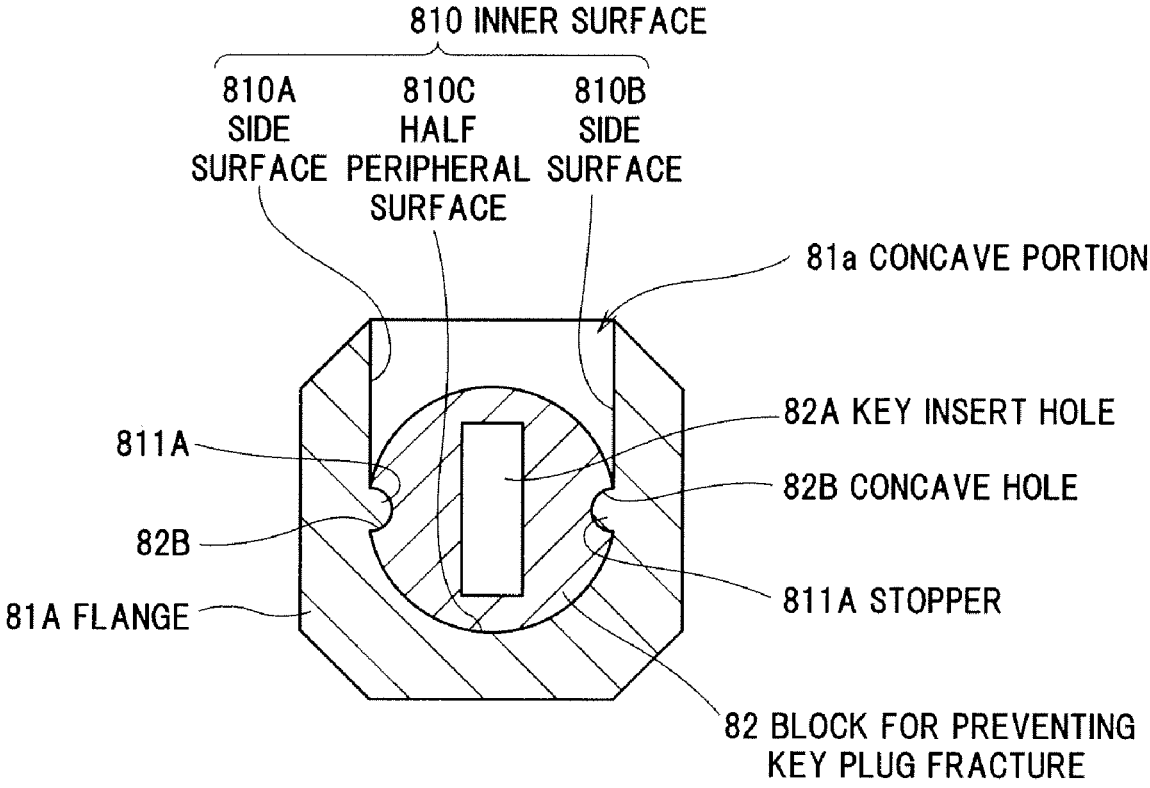
FIG. 6 is a cross sectional view along line D-D in FIG. 3B.
Figure 7A:
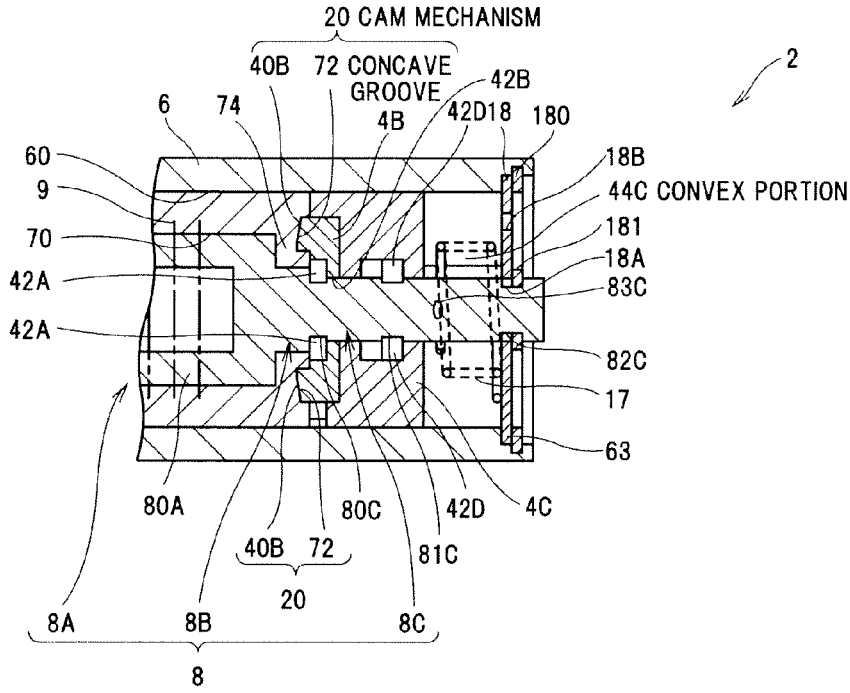
FIG. 7A and FIG. 7B are cross sectional views shown for explaining an operating condition of the cylinder lock in the preferred embodiment according to the present invention by an unauthorized key.
Figure 7B:
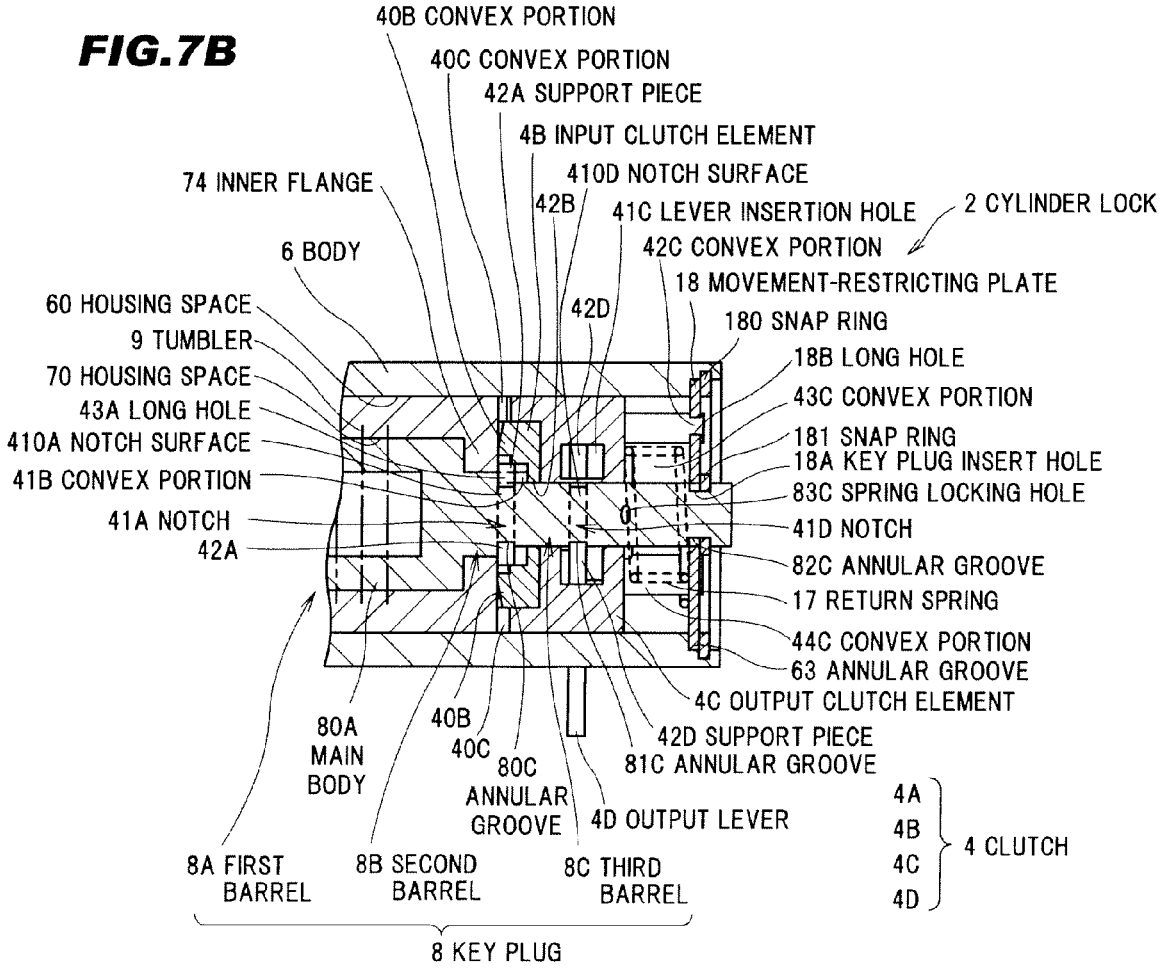

FIG. 1 is a perspective view shown for explaining the entire unlocking device in a preferred embodiment according to the present invention. FIGS. 2A and 2B are views shown for explaining a cylinder lock of the unlocking device in the preferred embodiment according to the present invention, wherein FIG. 2A shows a side view and FIG. 2B shows a rear view, respectively. FIGS. 3A and 3B are views showing a standby state of the cylinder lock in the preferred embodiment according to the present invention, wherein FIG. 3A shows a front view and FIG. 3B shows a cross sectional view along line A-A in FIG. 3A, respectively. FIGS. 4A and 4B are a cross sectional view along line B-B in FIG. 3A and a side view (excluding a body). FIG. 4A shows a cross sectional view along line B-B and FIG. 4B shows a side view, respectively. FIG. 5 is a cross sectional view along line C-C in FIG. 3A. FIG. 6 is a cross sectional view along line D-D in FIG. 3B. FIGS. 7A and 7B are cross sectional views shown for explaining an operating condition of the cylinder lock in the preferred embodiment according to the present invention by an unauthorized key. FIG. 7A shows a locking state of an input clutch element with a sleeve and FIG. 7B shows the input clutch element in a state of being withdrawn from the sleeve, respectively.

(Overall Structure of the Unlocking Device)

In FIG. 1, an unlocking device indicated by a reference number 1 substantially comprises a cylinder lock 2 activated by an insertion of a matching key (for example, a metal matching key), an operating handle 3 producing an unlocking movement (pivoting force) to unlock a door locking mechanism (for example, ratchet mechanism) and a handle operation force transmission mechanism 5 for transmitting an unlocking movement of the operating handle 3 to the cylinder lock 2 (a clutch).

(Structure of the Cylinder Lock 2)

As shown in FIG. 2 to FIG. 7, the cylinder lock 2 comprises a body 6 as am armoring member, a sleeve 7 housed in this body 6, a key plug 8 arranged in this sleeve 7, tumblers (locking plates) 9 as a key matching member movably supported on this key plug 8 and a clutch 4 for transmitting the unlocking movement of the operating handle 3 to a door locking mechanism in a state that these tumblers 9 are withdrawn from the sleeve 7, and is attached to a vehicle frame 200 via a bracket (not shown).

On the frame 200, as shown in FIG. 1, a pin 200A for a lever pivoting spindle protruding in a direction orthogonal to an insertion and extraction direction of the matching key within a pivot plane of the operating handle 3 is fixed.

As shown in FIG. 1, the body 6 comprises a barrel 6A in a cylindrical shape and a flange 6B in a square shape, and is fixed inside a door panel (not shown). As shown in FIG. 3B, a housing space 60 (shown in FIG. 7B) for housing the sleeve 7 and a key plug insert hole 61 opening on an edge face of a key insert (pull-out) side are provided inside the body 6. An inner flange 62 blocking a portion of the key plug insert hole 61 is provided at an edge of the key insert side of the body 6. A step-like shaped annular groove 63 (shown in FIG. 7B) opening in the housing space 60 is provided at an edge opposite to the edge of the key insert side (an edge of a key anti-insertion side) of the body 6.

As shown in FIG. 1, a pair of penetrating windows 60A and 61A parallel to each other at predetermined intervals in an axial direction and at equal intervals in a circumferential direction is provided in the barrel 6A of the body 6. The penetrating windows 60A and 61A are formed by long holes having a predetermined length in the circumferential direction of the barrel 6A.

As shown in FIG. 5, the sleeve 7 comprises a housing space 70 which can house a portion of a first barrel and a second barrel (both will be described later) of the key plug 8 and a bottomless cylindrical body having a opening 71 communicating with the key plug inset hole 61 (shown in FIG. 3B), is arranged in a position where an edge face of the key insert side contacts with the inner flange 62 (shown in FIG. 3B) inside the body 6, and is pivotally housed between predetermined two positions in the circumferential direction in the housing space 60 of the body 6.

As shown in FIG. 7B, a plurality of tumbler locking holes (not shown) opening in the housing space 70 are provided on an inner periphery of the sleeve 7. An inner flange 74 for blocking a portion of the housing space 70 is provided at an edge of the key anti-insertion side of the sleeve 7.

In the sleeve 7, as shown in FIG. 7A, concave grooves 72, 72 as a first cam element opening on an edge face opposite to the edge face of the key insert side (an edge face of the key anti-insertion side) are provided lying over the inner flange 74. The concave grooves 72, 72 are arranged in positions parallel to each other at equal intervals in the circumference direction, respectively. The both side surface of the concave grooves 72, 72 in the circumference direction are formed by slants progressively expanding the opening thereof toward an edge face of the opening in the axial direction from the groove bottom. The groove bottoms of the concave grooves 72, 72 are formed of partial planes orthogonal to an axis line of the sleeve 7. Furthermore, as shown in FIG. 4B, notches 73, 73 (one of them is shown) arranged at outer periphery of the concave grooves 72, 72 and opening on the edge face and an outer peripheral surface of the key anti-insertion side are provided in the sleeve 7.

As shown in FIG. 7B, the key plug 8 has a first barrel 8A, a second barrel 8B and a third barrel 8C, is arranged in the sleeve 7 (the housing space 70) and is fixed on the axis line of the body 6. And for example, the entire key plug 8 is formed of zinc die-cast member.

As shown in FIG. 3B, the first barrel 8A has a key insert hole 81 opening on the edge face of the key insert side allowing the matching key to be inserted and removed, and is formed of a main body 80A in a cylindrical shape and a flange 81A in a rectangular plate-like shape (non-circle). The key insert hole 81 is opened and closed by a shutter (not shown) on the key insert side.

The main body 80A is arranged in a position where the edge face of the key anti-insertion side faces the inner flange 74 of the sleeve 7 (the edge face of the key insert side). A plurality of tumbler holding holes (not shown) parallel in the key insertion and extraction direction and opening in a direction orthogonal to the insertion and extraction direction are provided in the main body 80A.

The flange 81A is arranged in a position where the edge face of the key anti-insertion side faces the inner flange 62 of the body 6 (the edge face of the key insert side). A concave portion 81*a* communicating with the key insert hole 81 and opening in a radial direction of the main body 80A is provided in the flange 81A.

As shown in FIG. 6, the concave portion 81*a* is formed of a space surrounded by side surfaces 810A and 810B facing each other and a U-shaped inner surface 810 comprising a half peripheral surface 810C connecting to these side surfaces 810A and 810B continuously, or the like. A block 82 for preventing key plug fracture as a plug element having a key insert hole 82A letting through the matching key by communicating with the key insert hole 81 (shown in FIG. 1) is rotatably arranged in the concave portion 81*a*.

The block 82 is formed by applying quenching treatment as hardening treatment to a disk-shaped press-molded body such as carbon steel for a mechanical structure (for example, S45C). Semispherical concave holes 82B, 82B being parallel at equal intervals in the circumferential direction and opening in the radial direction are provided on the outer peripheral surface of the block 82.

In the inner surface 810, semispherical breakable stoppers 811A, 811A are integrally provided, protruding between the side surface 810A and the half peripheral surface 810C and between the half peripheral surface 810C and the side surface 810B, respectively.

The stoppers 811A, 811A are configured to be arranged in a position to be engaged with the concave holes 82B, 82B of the block 82 and to restrict the block 82 to rotate around the axis line. Furthermore, the stoppers 811A, 811A are configured to prevent destruction of the key plug 8 (vehicle theft) by allowing the rotation of the block 82 when being broken by a drill or the like.

As shown in FIG. 3B, the second barrel 8B is connected to the first barrel 8A and the third barrel 8C continuously and is arranged on an axis line of the key insert hole 81. In addition, the entire second barrel 8B is formed by a cylinder having an outer diameter smaller than that of the first barrel 8A (main body 80A).

As shown in FIG. 7B, the third barrel 8C has annular grooves 80C, 81C and 82C parallel at predetermined intervals in the axial direction and is arranged on an axis line of the second barrel 8B. And it is configured to function as a pivoting spindle for pivotally supporting each component of the clutch 4 (below-described lever and clutch element). The outer diameter of the third barrel 8C is set to be a dimension smaller than that of the second barrel 8B. A spring locking hole 83C for locking one edge of a return spring 17 to impart a movement return force to an output clutch element of the clutch 4 (described later) is provided in the third barrel 8C.

The annular groove 80C is arranged in a position adjacent to the edge face of the key anti-insertion side of the second barrel 8B, the annular groove 82C is arranged in a position where the groove bottom thereof faces that of the annular groove 63 of the body 6 and the annular groove 81C is arranged in a position intervening between the both annular grooves 80C and 82C, respectively. Among these annular grooves 80C, 81C and 82C, the annular groove 82C is configured to function as a plate positioning groove to determine a position of a movement-restricting plate 18, which restricts the movement of the output clutch element of the clutch 4 in the circumferential direction, to the key anti-insertion side of the key plug 8 with the annular groove 63 (the body 6).

As shown in FIG. 7B, the movement-restricting plate 18 comprises a annular plate having a key plug insert hole 18A letting through the third barrel 8C of the key plug 8 and long holes 18B, 18C and 18D (shown in FIG. 2) being parallel at equal intervals around this movement-restricting plate 18, are arranged on the axis line of the sleeve 7 and are attached between the outer peripheral surface of the key plug 8 and the inner peripheral surface of the body 6 so that an inner peripheral edge and an outer peripheral edge of the plate face the annular groove 82C and the annular groove 63 respectively. For example, snap rings 180 and 181 such as a C-ring, an E-ring or the like are used for attaching the movement-restricting plate 18.

As shown in FIG. 7A and FIG. 7B, the tumblers 9 are arranged to be insertable and removable (detachable) in the tumbler locking holes of the sleeve 7 and is movably supported by the tumbler holding holes of the same sleeve 7. And the tumblers 9 are configured to be withdrawn from the tumbler locking holes by an insert operation of the matching key to the key plug 8 (the key insert hole 81) and to be inserted (locked) into the tumbler locking holes by a pull-out operation of the matching key from the key plug 8. A resilient force of a tumbler return spring (not shown) in a direction inserted into the tumbler locking holes is imparted to the tumblers 9.

As shown in FIG. 4, the clutch 4 has an input lever 4A which pivots by receiving the unlocking movement from the operating handle 3 (shown in FIG. 1), an input clutch element 4B which pivots and moves by an input of the unlocking movement from the input lever 4A, an output clutch element 4C which moves in an axial direction by receiving the moving force from this input clutch element 4B and an output lever 4D which pivots by receiving the pivoting force from this output clutch element 4C. The clutch 4 is arranged on the key anti-insertion side, is housed in the housing space 60 of the body 6, and is configured to intermit between the operating handle 3 and the door locking mechanism by moving in the key insertion direction and the key anti-insertion direction of the input clutch element 4B and the output clutch element 4C (withdrawal from the sleeve 7 and locking to the sleeve 7).

As shown in FIG. 1, the input lever 4A is coupled with the handle operation force transmission mechanism 5 (below-described transmitting link 21) and is rotatably supported on the third barrel 8C (shown in FIG. 3B) of the key plug 8 penetrating through the penetrating window 60A of the body 6. A link coupling hole 40A for pivotally coupling the transmitting link 21 is provided at one edge of the input lever 4A. At another edge of the input lever 4A, as shown in FIG. 7B, support pieces 42A, 42A facing a groove face of the annular groove 80C of the key plug 8 are provided by forming a notch 41A at an end edge of a longitudinal direction of the lever. As a result, the movement of the key plug 8 in the axial direction is restricted and backlash of the input lever 4A is prevented.

The notch 41A has a half peripheral surface fitted in a groove bottom (periphery) of the annular groove 80C of the key plug 8 and a notch surface 410A comprising a pair of side surfaces connecting to this half peripheral surface continuously, and is configured to allow the input lever 4A to pivot around the axis line of the key plug 8.

As shown in FIG. 4A, a long hole 43A located at a substantially center of the longitudinal direction of the lever and opening on both edge faces (the edge face of the key insert side and that of the key anti-insertion side) is provided around along the axis line of the key plug 8 in the input lever 4A.

The input clutch element 4B is arranged between the sleeve 7 and the output clutch element 4C and is supported around the third barrel 8C of the key plug 8 to be rotatable and movable. And, it is configured to pivot with the input lever 4A by receiving the unlocking movement of the operating handle 3.

On the edge face of the key insert side of the input clutch element 4B, as shown in FIG. 7A, convex portions 40B, 40B are provided as a second cam portion protruding toward the key insert side and detachably fitting (coupling) with the concave grooves 72, 72 of the sleeve 7.

The convex portions 40B, 40B compose a cam mechanism 20 with the concave grooves 72, 72 and are arranged in positions parallel to each other at equal intervals in the circumferential direction of the input clutch element 4B. And, the convex portions 40B, 40B are configured to withdraw the output clutch element 4C from the sleeve 7 by moving the input clutch element 4B in the axial direction by the pivotal movement thereof so as to press the output clutch element 4C in the key insertion direction in a state that the tumblers 9 are locked. The both side surfaces of the convex portions 40B, 40B in the circumferential direction are formed by slants fitting to slants of the concave grooves 72, 72 (both side surfaces in the circumferential direction). Edge faces of the convex portions 40B, 40B are formed by partial planes fitted to the groove bottom of the concave grooves 72, 72.

Furthermore, as shown in FIG. 4A, a convex portion 41B fitted in the long hole 43A of the input lever 4A to be movable in the axial direction of the key plug 8 is provided on the edge face of the key insert side of the input clutch element 4B. As a result, the input clutch element 4B is movably coupled with the input lever 4A. In this way, since the input clutch element 4B is movably coupled with the input lever 4A and is also supported on the third barrel 8C of the key plug 8 to be rotatable and movable as mentioned above, it is possible to enhance an assembling property of the input clutch element 4B to the body 6 and a stable movement of the input clutch element 4B in two direction (a pivotal movement and a shifting motion) can be obtained.

As shown in FIG. 4A, a key plug insert hole 42B letting through the third barrel 8C of the key plug 8 is provided in the input clutch element 4B. As a result, it is possible to assemble the input clutch element 4B by arranging the key plug insert hole 42B of the input clutch element 4B on the axis line of the key plug 8 (the third barrel 8C), sequentially letting through the key plug insert hole 42B to the edge face of the key anti-insertion side of the third barrel 8C and subsequently fitting the convex portion 41B of the input clutch element 4B into the long hole 43A of the input lever 4A preliminarily assembled to the third barrel 8C from the radial direction.

The output clutch element 4C is arranged on the key anti-insertion side of the sleeve 7, is supported around the third barrel 8C of the key plug 8 to be rotatable and movable, and the entire output clutch element 4C is formed of a cylindrical body for housing the edge of the key anti-insertion side of the input clutch element 4B. And it is configured to pivot with the output lever 4D by receiving the unlocking movement of the operating handle 3 from the sleeve 7. A movement return force in the key anti-insertion direction is imparted to the output clutch element 4C by the return spring 17.

As shown in FIG. 4B, convex portions 40C, 40C (only one of them is shown) protruding toward the key insert side and detachably fitting (coupling) with the notches 73, 73 (only one of them is shown) of the sleeve 7 respectively, are provided on the edge face of the key insert side (opening) of the output clutch element 4C. A lever insertion hole 41C (shown in FIG. 7B) letting through the output lever 4D is provided on an intermediate portion of the axial direction of the output clutch element 4C.

Furthermore, a convex portion 45C fitting with a long hole 43D (described later) of the output lever 4D to be movable in axial direction of the key plug 8 is provided on the edge face of the key insert side of the output clutch element 4C. As a result, the output clutch element 4C is movably coupled with the output lever 4D. In this way, since the output clutch element 4C is movably coupled with the output lever 4D and is also supported on the third barrel 8C of the key plug 8 to be rotatable and movable as mentioned above, it is possible to enhance an assembling property of the output clutch element 4C to the body 6 and a stable movement of the output clutch element 4C in two direction (a pivotal movement and a shifting motion) can be obtained.

On the edge face of the key anti-insertion side of the output clutch element 4C, as shown in FIG. 2B, convex portions 42C, 43C and 44C fitting with the long holes 18B, 18C and 18D of the movement-restricting plate 18 respectively to be movable in the axial direction of the key plug 8 are provided in a protruding condition. As a result, in the state that the tumblers 9 are locked to the sleeve 7 (the tumbler locking hole), when the output clutch element 4C moves in the key insertion direction by the pivotal movement of the input clutch element 4B, the pivotal movement of the output clutch element 4C is restricted by fitting the convex portions 42C, 43C and 44C with the long holes 18B, 18C and 18D. As a result, the pivotal movement of the output lever 4D by an unauthorized act using a drill or the like is interrupted and the unlocking of the door locking mechanism is prevented.

As shown in FIG. 1, the output lever 4D is coupled with the door locking mechanism via a transmitting link 21 and is rotatably supported on the third barrel 8C of the key plug 8 penetrating through the penetrating window 61A of the body 6 and the lever insertion hole 41C (shown in FIG. 7B) of the output clutch element 4C. A link coupling hole 40D coupling the transmitting link 21 to be oscillated is provided on one edge of the output lever 4D. On another edge of the output lever 4D, as shown in FIG. 7B, support pieces 42D, 42D facing the groove face of the annular groove 81C of the key plug 8 are provided by forming a notch 41 at an end edge of a longitudinal direction of the lever. As a result, the movement of the key plug 8 in the axial direction is restricted and backlash of the output lever 4D is also prevented.

The notch 41D has a half peripheral surface fitted in a groove bottom (periphery) of the annular groove 80C of the key plug 8 and a notch surface 410D comprising a pair of side surfaces connecting to this half peripheral surface continuously, and is configured to allow the output lever 4D to pivot around the axis line of the key plug 8.

As shown in FIG. 4A, a long hole 43D located at a substantially center of the longitudinal direction of the lever and opening on both edge faces (the edge face of the key insert side and that of the key anti-insertion side) is provided around along the axis line of the key plug 8 in the output lever 4D.

(Structure of the Operating Handle 3)

As shown in FIG. 1, the operating handle 3 has a operating portion 3A for imparting a pivoting force (a handle operation force) in a direction to unlock the door locking mechanism (an unlocking direction of the door locking mechanism) to a transmission lever 5A of the handle operation force transmission mechanism 5 via wire 22 and a switch 3B for electrically unlocking the door locking mechanism and is rotatably supported on the frame 200, and return characteristics are imparted thereto by a return spring (not shown). And it is configured to pivot by the pivotal operation of the operating portion 3A in a predetermined pivot range around a pin for a handle pivoting spindle as a turning center so as to produce an unlocking movement for unlocking the door locking mechanism. As a result, when the operating handle 3 is pivotally operated in the unlocking direction of the door locking mechanism in a state that the tumblers 9 are withdrawn by an insertion of the matching key into the key insert hole 81, this operation force is transmitted to the clutch 4 via the handle operation force transmission mechanism 5 and further transmitted to the door locking mechanism from this clutch 4 via the transmitting link 21, and this door locking mechanism is unlocked. Furthermore, when the operation state of the operating handle 3 is released, the operating handle 3 pivotally returns with the transmission lever 5A by the return spring and is arranged in a return position thereof (the position before operating the operating handle 3).

When the operating handle 3 is operated pivotally in an opening direction of the door panel in the unlocking state of the door locking mechanism, since the door locking mechanism is unlocked, the door panel is opened pivoting in the opening direction around a pivot bearing. Furthermore, when closing the door panel by pivotally operating in the closing direction in the open state, the door lock mechanism is locked.

(Structure of the Handle Operation Force Transmission Mechanism 5)

As shown in FIG. 1, the handle operation force transmission mechanism 5 has a transmission lever 5A pivoting by receiving a handle operation force (a pivotal operation force) of the operating handle 3 and a transmitting link 5B oscillating by receiving the pivoting force from this transmission lever 5A, and is supported on the frame 200 intermediating between the operating handle 3 (the wire 22) and the clutch 4. And it is configured to transmit the handle operation force (the pivoting force) of the operating handle 3 to the clutch 4 as mentioned above.

The transmission lever 5A comprises a substantially arcuate-shaped pivot lever having a pin hole 50A at a center of the lever for fitting with the pin 200A for a lever pivoting spindle, is arranged inside the door panel and rotatably supported on the frame 200 via the pin 200A. A link coupling hole 51A for coupling a transmitting link 5B to be oscillated is provided at one side edge of the transmission lever 5A. A wire connecting hole 52A for coupling the transmitting link 21 is provided at another side edge of the transmission lever 5A.

The transmitting link 5B is arranged between the transmission lever 5A and the clutch 4 (the input lever 4A), and is configured to oscillate by receiving the pivoting force from the transmission lever 5A. One side edge of the transmitting link 5B is coupled with the link coupling hole 51A of the transmission lever 5A so as to be oscillated and another side edge is coupled with the link coupling hole 40A of the input lever 4A so as to be oscillated, respectively.

(Motion of the Unlocking Device 1)

Figure 8B:
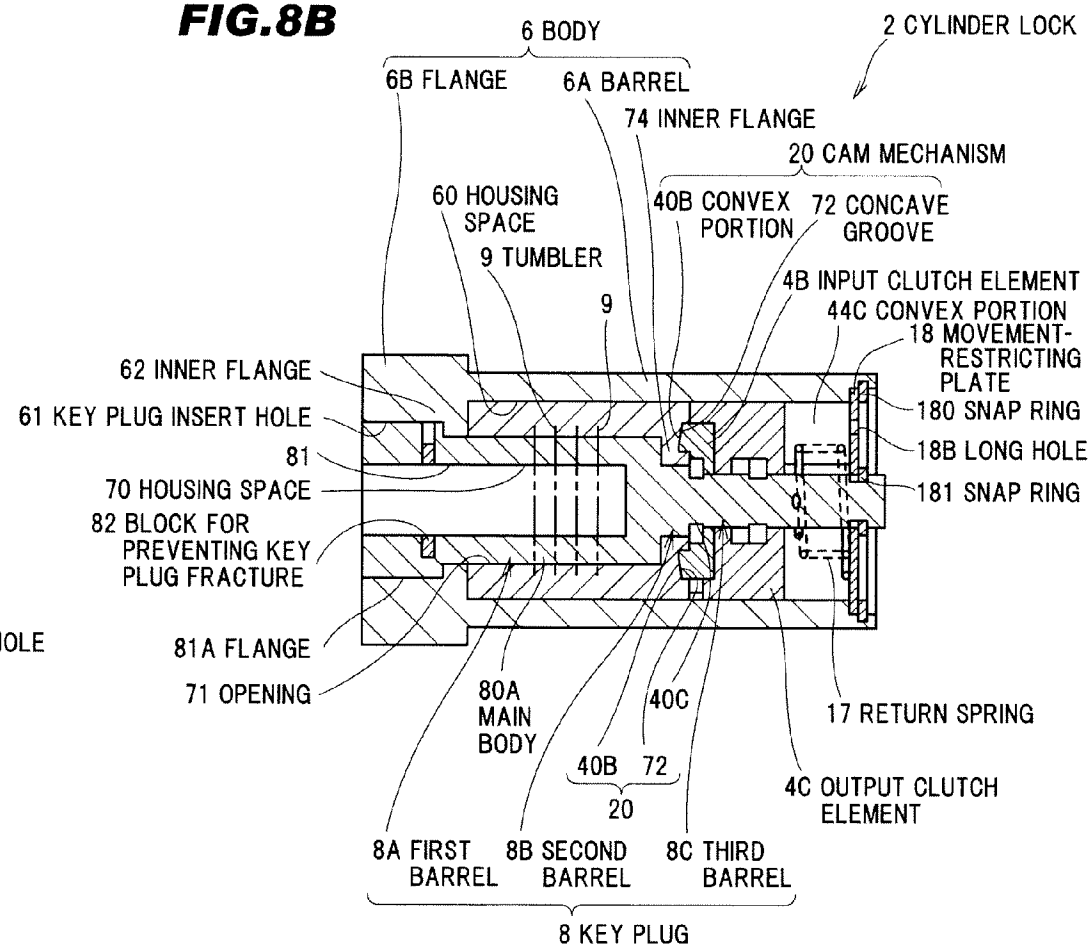
Figure 8A:
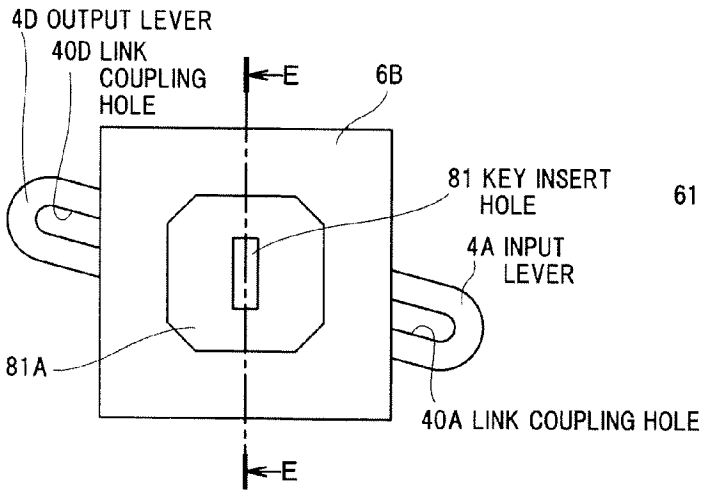
Figure 9B:
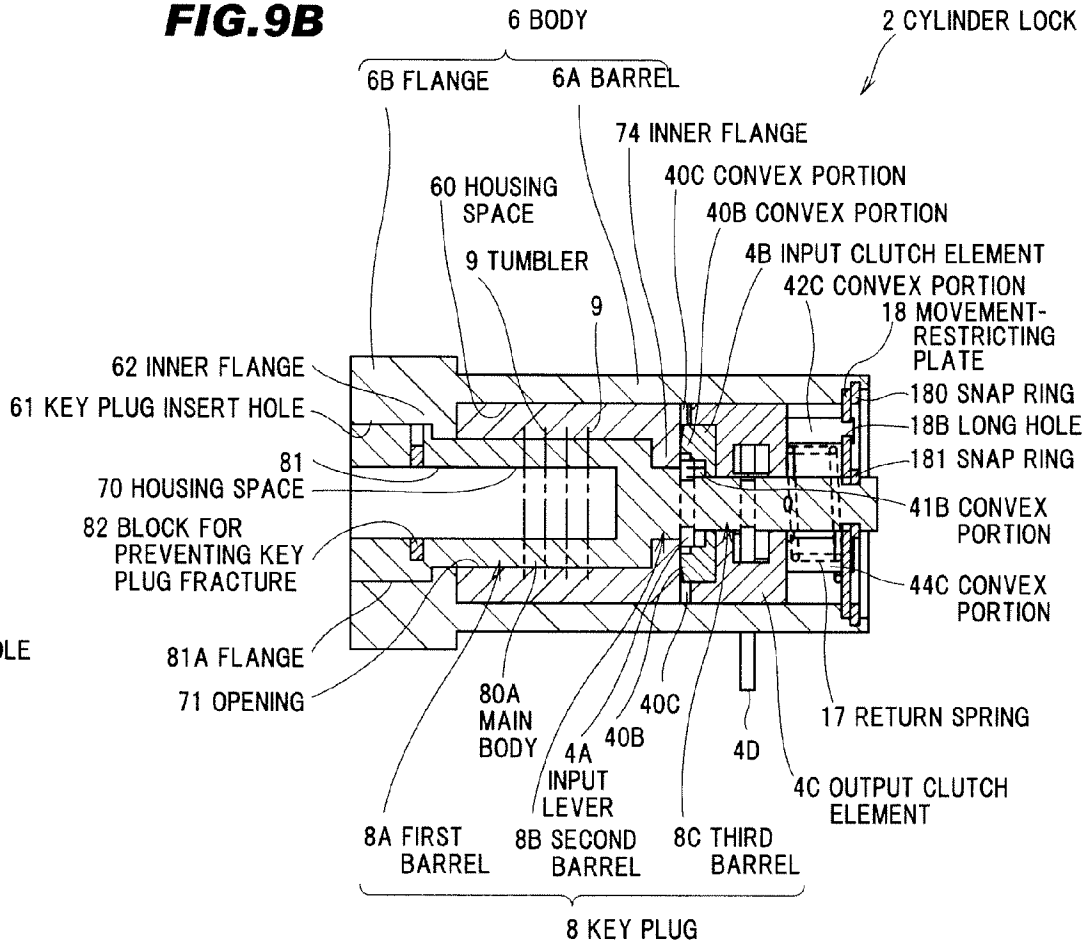
Figure 9A:
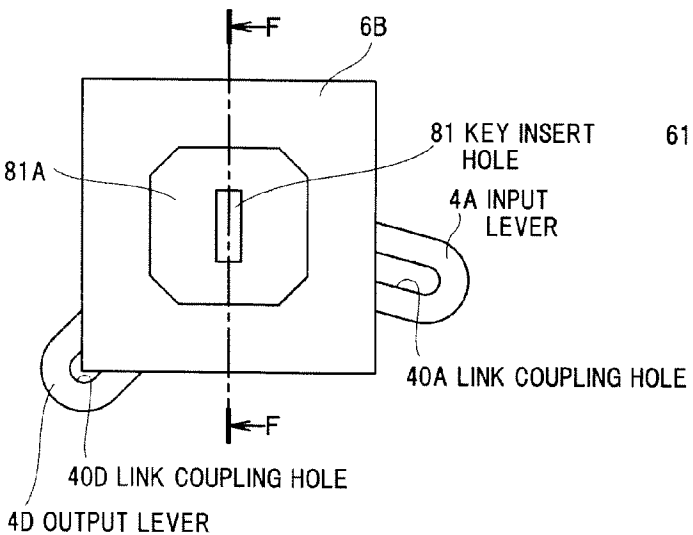

FIGS. 8A and 8B are views showing an operating condition of the cylinder lock in the preferred embodiment according to the present invention by a matching key, wherein FIG. 8A shows a front view and FIG. 8B shows a cross sectional view along line E-E in FIG. 8A, respectively. FIGS. 9A and 9B are views showing an operating condition of the cylinder lock in the preferred embodiment according to the present invention by the unauthorized key, wherein FIG. 9A shows a front view and FIG. 9B shows a cross sectional view along line F-F in FIG. 9A, respectively.

In the locking state of the door locking mechanism, as shown in FIG. 3A and FIG. 3B, since the tumblers 9 are locked into the sleeve 7 (the tumbler locking holes), the matching key is inserted into the key insert hole 81 of the key plug 8 so as to switch the door locking mechanism from a locking state to an unlocking state. In this case, when the matching key is inserted into the key insert hole 81 of the key plug 8, key fitting holes (not shown) of the tumblers 9 are engaged with corresponding convexes and concaves of the matching key respectively, and the tumblers 9 are withdrawn from the sleeve 7 moving in the key plug 8 (the tumbler holding holes) against the resilient force of the return spring. As a result, the locking state of the key plug 8 to the sleeve 7 is released.

Next, as shown in FIG. 1, a pivotal (handle) operation of the operating handle 3 is conducted in an arrow-a direction (a direction to open the door panel) to unlock the door locking mechanism. In this case, when the operating handle 3 (the operating portion 3A) is pivotally operated, this pivotal operation force is transmitted to the handle operation force transmission mechanism 5 via the wire 22 by acting in an arrow-b direction and further transmitted to the clutch 4 from the handle operation force transmission mechanism 5 (the transmission lever 5A and the transmitting link 5B).

In the clutch 4, when the input lever 4A inputs the pivoting force from the transmitting link 5B as shown in FIG. 8A and FIG. 8B, since the locking state of the key plug 8 into the sleeve 7 is released, the input clutch element 4B and the sleeve 7 pivot by the pivotal movement of the input lever 4A in an arrow-c direction and the output clutch element 4C pivots at the same time, and in accordance with this movement, the output lever 4D pivots in an arrow-d direction by receiving the pivoting force from the output clutch element 4C as shown in FIG. 1.

Therefore, the pivoting force of the output lever 4D is transmitted to the door locking mechanism via the transmitting link 21 and the door locking mechanism is unlocked by receiving the unlocking movement.

When the operating handle 3 is pivotally operated in the opening direction of the door panel after this in the unlocking state of the of the door locking mechanism, since the door locking mechanism is unlocked, the door panel is opened pivoting in the opening direction around a pivot bearing.

Meanwhile, in the locking state of the door locking mechanism, for example, when an unauthorized key is inserted into the key insert hole 81 of the key plug 8, the tumblers 9 are still locked into the sleeve 7 (tumbler locking hole) without being withdrawn from the sleeve 7.

From this state, a pivotal (handle) operation of the operating handle 3 is conducted in an arrow-a direction (a direction to open the door panel) to unlock the door locking mechanism. In this case, when the operating handle 3 (the operating portion 3A) is pivotally operated, this pivotal operation force is transmitted to the handle operation force transmission mechanism 5 via the wire 22 by acting in an arrow-b direction and further transmitted to the clutch 4 from the handle operation force transmission mechanism 5 (the transmission lever 5A and the transmitting link 5B).

In the clutch 4, when the input lever 4A inputs the pivoting force from the transmitting link 5B as shown in FIG. 9A and FIG. 9B, since the locking state of the tumblers 9 into the sleeve 7 is maintained, although the input clutch element 4B pivot by the pivotal movement of the input lever 4A in the arrow-c direction shown in FIG. 1, the sleeve 7 does not pivot. Here, when the input clutch element 4B pivots, the input clutch element 4B moves in the key insertion direction in accordance with this pivotal movement by an action of the cam mechanism 20 and the locking state of the input clutch element 4B to the sleeve 7 is released. Furthermore, when the input clutch element 4B moves in the key insertion direction, the output clutch element 4C is withdrawn by being pressed and the locking state of the output clutch element 4C to the sleeve 7 is released. Therefore, the coupled state of the operating handle 3 (the input clutch element 4B) with the door locking mechanism (the output clutch element 4C) is released. As a result, the pivoting force (the handle operation force) from the operating handle 3 is not transmitted to the door locking mechanism via the clutch 4, hence, the door locking mechanism is not unlocked.

When conducting a pivotal (handle) operation of the operating handle 3 in the unlocking direction of the door locking mechanism in the state that the door locking mechanism is locked, since the tumblers 9 are not withdrawn from the sleeve 7 (tumbler locking hole) and still locked into the sleeve 7, the handle operation force of the operating handle 3 is not transmitted to the door locking mechanism, hence, the door locking mechanism is not unlocked in this case, neither.

Effect of the Preferred Embodiment

According to the preferred embodiment described above, following effects can be obtained.

(1) Since a rod for a cylinder lock and a key lever mechanism which are conventionally required are not necessary, it is possible to reduce the number of parts assembled and possible to seek the simplification of the entire structure and the cost reduction.

(2) Since a rod for a cylinder lock and a key lever mechanism are not necessary, it is possible to lessen the outside dimension and possible to seek the miniaturization of the entire structure.

(3) Since the output clutch element 4C is withdrawn from the sleeve 7 by movement by the pivotal movement of the input clutch element 4B when an unauthorized key is inserted into the key insert hole 81 of the key plug 8, the connection between the operating handle 3 and the door locking mechanism is blocked off. As a result, the unlocking movement of the operating handle 3 is not transmitted to the door locking mechanism, hence, it is possible to prevent the unlocking of the door locking mechanism by the unauthorized key.

(4) Since only an insertion operation is required for an operation of the matching key instead of the insertion and pivotal operations when unlocking the door locking mechanism, it is possible to reduce loading which acts on the matching key. As a result, it is not necessary to form the matching key from a material having high mechanical strength or to increase the thickness of the key for enhancing rigidity of the matching key, hence, it is possible to seek lower manufacturing costs for the matching key.

(5) Since the input clutch element 4B and the output clutch element 4C are movably coupled with the input lever 4A and the output lever 4D respectively and are supported on the third barrel 8C of the key plug 8 to be rotatable and movable, it is possible to enhance assembling property of the input clutch element 4B and the output clutch element 4C to the body 6 and a stable movement of the input clutch element 4B and the output clutch element 4C in two direction (a pivotal movement and a shifting motion) can be obtained.

(6) Since the block 82 for preventing key plug fracture is rotatably arranged on the key insert side of the key insert hole 81, it is possible to prevent destruction, eventually a vehicle theft, by allowing the block 82 to rotate.

Although the unlocking device according to the present invention has been described based on the above preferred embodiment, the invention is not limited by the above preferred embodiment and it is possible to implement in various features without going beyond a scope of the concept. For example, following variation can be made.

(1) In this preferred embodiment, although the metal matching key is explained, the present invention is not limited thereto, since the cylinder lock is not intended to rotate the matching key, a matching key may be a resin or paper and forming materials thereof can be appropriately changed.

(2) In this preferred embodiment, although it is explained that the operating handle 3 moves pivotally, the present invention is not limited thereto, it may be an operating handle which moves forward and backwards.

(3) In this preferred embodiment, although it is explained that the cylinder lock 2 is attached to the frame 200 via a bracket (not shown), the present invention is not limited thereto, a cylinder lock may be directly attached to a frame or a door panel, respectively.

(4) In this preferred embodiment, although it is explained that the unlocking of the door locking mechanism for the vehicle door panel is conducted, the present invention is not limited thereto. Hence, it may be the unlocking of the door locking mechanism for other door panels, furthermore, it is applicable to unlock locking mechanisms other than the door locking mechanism in the same way as this preferred embodiment.

Although the invention has been described with respect to the specific embodiments for complete and clear disclosure, the appended claims are not to be therefore limited but are to be construed as embodying all modifications and alternative constructions that may occur to one skilled in the art which fairly fall within the basic teaching herein set forth.

What is claimed is:

1. A cylinder lock, comprising:

a sleeve;

a key plug arranged in the sleeve and having a key insert hole opening on a face of a key insert side;

a key matching tumbler member movably supported on the key plug, detachably engaged to the sleeve and withdrawn from engagement with the sleeve by an insertion of a matching key into the key insert hole; and a clutch arranged on an opposite side of the key insert side of the sleeve for transmitting an unlocking movement of an operating handle to a locking mechanism, wherein the clutch has an input clutch element moved by the unlocking movement of the operating handle, and an output clutch element moved by the input clutch element, and the output clutch element is detachably coupled with the sleeve, and the input clutch element is detachably coupled with the sleeve and wherein the input clutch element withdraws the output clutch element in the sleeve in an axial direction as a result of a pivotal movement caused by the unlocking movement of the operating handle when the key matching tumbler member is in a locking state.

2. The cylinder lock according to claim 1, wherein the input clutch element comprises a cam mechanism between the sleeve and the input clutch element for moving the output clutch element in said withdrawal direction by the pivotal movement.

3. The cylinder lock according to claim 1, wherein pivotal movement of the output clutch element is restricted when said output clutch element is withdrawn within the sleeve.

4. The cylinder lock according to claim 1, wherein a block for preventing key plug fracture is pivotally arranged on the key insert side of the key insert hole in the key plug.

5. The cylinder lock according to claim 4, wherein the block for preventing key plug fracture has a breakable stopper for restricting rotation of the key plug, and the key plug has a concave portion that fits with the stopper.

6. The cylinder lock according to claim 1, wherein the input clutch element is movably coupled with an input lever pivotally supported on the key plug, and the input clutch element is rotatably and movably supported on the key plug.

7. The cylinder lock according to claim 6, wherein the input clutch element pivots with the input lever when the input lever receives the unlocking movement of the operating handle.

8. The cylinder lock according to claim 1, wherein the output clutch element is movably coupled with an output lever pivotally supported on the key plug, and is rotatably and movably supported on the key plug.

9. The cylinder lock according to claim 1, wherein the output clutch element pivots upon receiving the unlocking movement of the operating handle from the sleeve.

10. An unlocking device, comprising:

a cylinder lock operated by an insertion of a matching key; and an operating handle producing an unlocking movement for unlocking a locking mechanism, wherein the cylinder lock comprises:

a sleeve;

a key plug arranged in the sleeve and having a key insert hole opening on a face of a key insert side;

a key matching tumbler member movably supported on the key plug, detachably engaged to the sleeve when in a locking state and withdrawn from engagement with the sleeve when in an unlocking state by an insertion of a matching key into the key insert hole; and a clutch arranged on an opposite side of the key insert side of the sleeve for transmitting an unlocking movement of the operating handle to a locking mechanism, wherein the clutch has an input clutch element moved by the unlocking movement of the operating handle and an output clutch element moved by the input clutch element, and both the output clutch element and the input clutch element are detachably coupled with the sleeve, and wherein the input clutch element withdraws the output clutch element in the sleeve in an axial direction as a result of a pivotal movement caused by the unlocking movement in said locking state of the key matching tumbler member.

* * * * *